United States Patent [19]

Miyata

[11] Patent Number: 4,761,896

[45] Date of Patent: Aug. 9, 1988

[54] APPARATUS FOR PROCESSING DRY-CLEANED CLOTHES

[76] Inventor: Yukio Miyata, No. 738-4, Kodera, Mihara-cho, Minami-Kawachi-gun, Osaka, Japan

[21] Appl. No.: 82,574

[22] Filed: Aug. 6, 1987

[30] Foreign Application Priority Data

Jan. 16, 1987 [JP] Japan ..... 62-8544

[51] Int. Cl.[4] ..... F26B 9/06

[52] U.S. Cl. ..... 34/77; 34/148; 34/151

[58] Field of Search ..... 34/73, 74, 75, 76, 77, 34/78, 148, 151

[56] References Cited

U.S. PATENT DOCUMENTS

| | | | |
|---|---|---|---|
| 3,432,939 | 3/1969 | Eichholz | 34/151 |
| 3,538,615 | 11/1970 | Fuhring et al. | 34/74 |
| 3,738,019 | 6/1973 | Forg et al. | 34/212 |
| 3,805,561 | 4/1974 | Bullock | 34/151 |
| 4,494,317 | 1/1985 | Biagl et al. | 34/76 |
| 4,682,424 | 7/1987 | Irving | 34/151 |

*Primary Examiner*—Larry I. Schwartz
*Attorney, Agent, or Firm*—Moonray Kojima

[57] ABSTRACT

An apparatus for perfectly processing dry-cleaned clothes such as suits, trousers, skirts, for example by sequentially executing drying, smoothing creases of dry-cleaned clothes, and collection of solvent evaporated from dry-cleaned clothes. More particularly, the apparatus related to the invention first dries the dry-cleaned clothes by causing hot air current from heating means and air-circulation path to circulate itself from the upper portion of the drying chamber downward, while the apparatus simultaneously collects solvent from the dry-cleaned clothes, and then smoothes out creases by effectively combining steaming effect from steam-supply means together with provision of swinging movement and downward tension against the dry-cleaned clothes before eventually cooling the dry-cleaned clothes by introducing atmospheric air for preventing the smoothed creases from restoring themselves.

2 Claims, 3 Drawing Sheets

APPARATUS FOR PROCESSING DRY-CLEANED CLOTHES

SUMMARY OF THE INVENTION

The present invention relates to an apparatus for perfectly processing dry-cleaned clothes such as suits, trousers, skirts, for example by sequentially executing drying, smoothing creases of dry-cleaned clothes. More particularly, the apparatus related to the invention first dries the dry-cleaned clothes by causing hot air current from heating means and air-circulation path to circulate itself from the upper portion of the drying chamber downward, while the apparatus simultaneously collects solvent from the dry-cleaned clothes, and then smoothes out creases by effectively combining steaming effect from steam-supply means together with provision of swinging movement and downward tension against the dry-cleaned clothes before eventually cooling the dry-cleaned clothes by introducing atmospheric air for preventing the smoothed creases from restoring themselves.

DESCRIPTION OF THE PRIOR ART

When drying those clothes subjected to dry cleaning with volatile solvent using any conventional means for example, a cylindrical tumbler solving the dry-cleaned clothes receives drying air while rotating itself. However, since the dry-cleaned clothes easily tangle themselves inside of the tumbler to eventually damage the clothes quality, those quality fabrics like cashmere or angora wool cannot be treated with tumbler drying process, and yet, there is potential hazard of causing an explosion to take place by accidental ignition of volatile solvent evaporated from the dry-cleaned clothes.

Although there is such an apparatus for drying those dry-cleaned clothes by means of hanging, since this apparatus is equipped with a conventional air-conditioner to cool temperature of solvent to be collected, this apparatus needs to install a cooling tower, thus resulting in the expensive cost. Furthermore, such an ideal apparatus capable of collectively executing executing crease-smoothing and drying functions has not yet been materialized, thus obliging the dry-cleaning shops to install a crease-smoothing apparatus in addition to the drying apparatus. This eventually results in the expensive equipment cost and higher cleaning cost as well.

OBJECT OF THE INVENTION

The primary object of the invention is to provide a novel apparatus for totally finishing up the dry-cleaned clothes by sequentially executing drying operation, collection of used solvent, crease-smoothing operation, and final cooling operation by applying an identical apparatus.

Another object of the invention is to provide a novel apparatus which prevents the dry-cleaned clothes from tangling themselves by drying these clothes while being hung inside of the apparatus so that quality fabrics like cashmere and angora wool cannot be damaged at all.

Another object of the invention is to provide a novel apparatus which is capable of effectively smoothing creases by applying vibration and downward tension to the dry-cleaned clothes by orienting the air current direction from the upper position to the lower position before allowing air to flow inside of the drying chamber.

Another object of the invention is to provide a novel apparatus for processing the dry-cleaned clothes capable of fully collecting used solvent evaporated from these clothes for repeatedly recycling it without causing odor of volatile solvent to remain in them and also without allowing used solvent to atmospherically evaporate itself before collection, thus eventually saving solvent and running cost, and yet, contributing to protection of clean atmosphere.

Another object of the invention is to provide a novel apparatus capable of drastically saving the time needed for fully processing the dry-cleaned clothes by dispensing with any of those conventional processing facilities.

A still further object of the invention is to provide a novel apparatus featuring simple constitution and inexpensive cost by providing the solvent collector with a water-circulating radiator for cooling temperature of collectable solvent.

DESCRIPTION OF THE PREFERRED EMBODIMENTS

Referring now more particularly to the accompanying drawings, one of the preferred embodiments of the apparatus related to the invention is described below.

Figure 1:
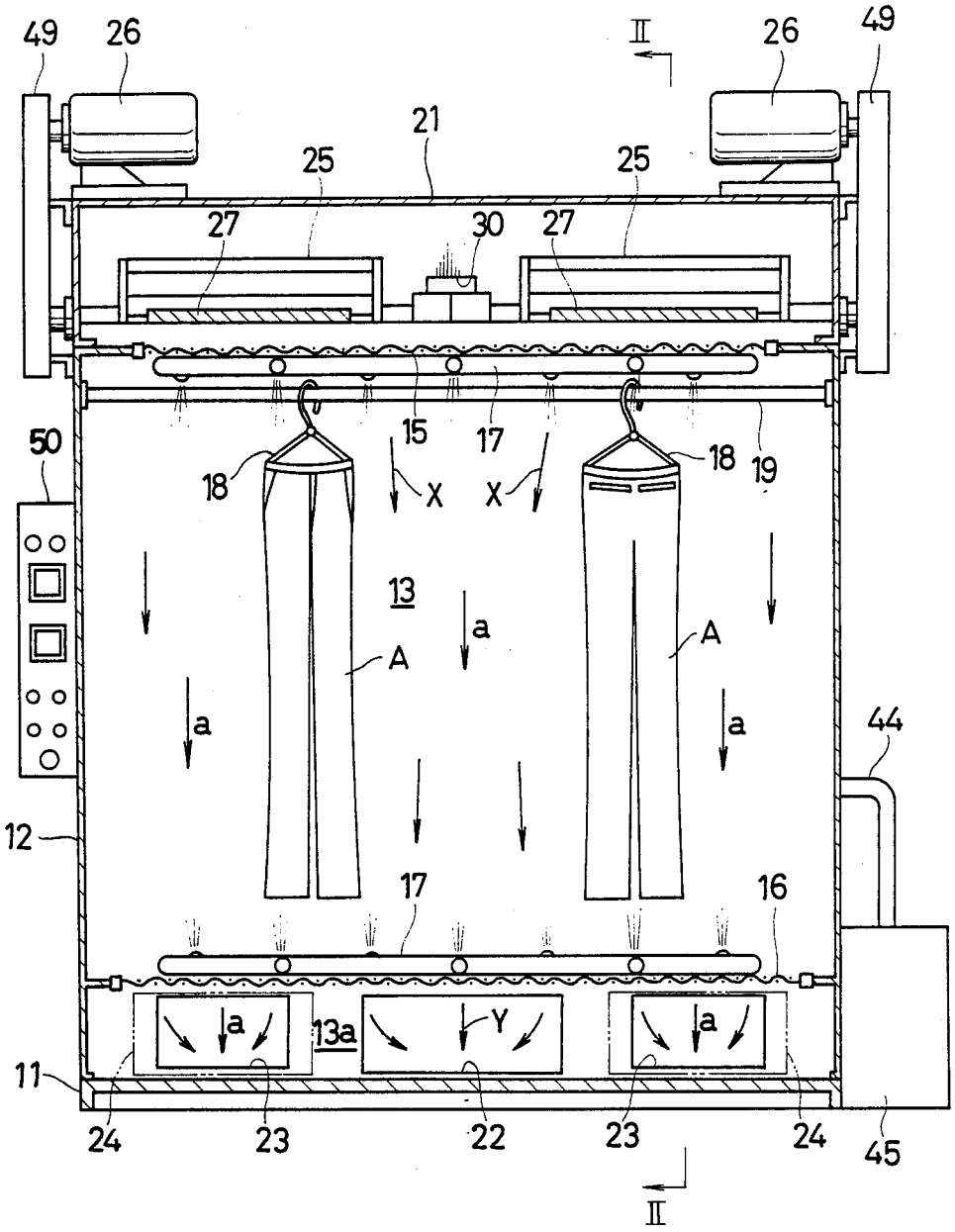
FIG. 1 is the sectional view of the apparatus for processing dry-cleaned clothes related to the invention, which is equipped with the solvent collector.
Figure 2:
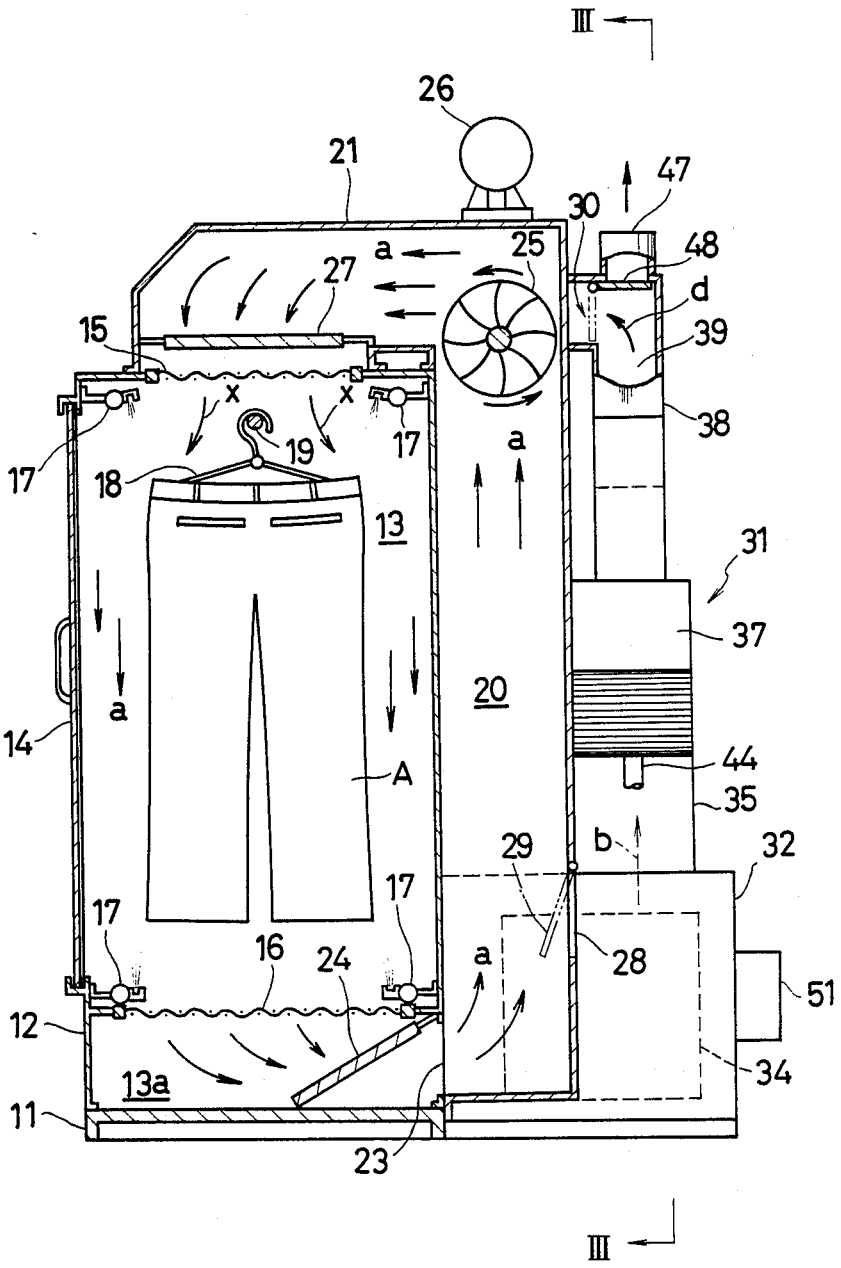
FIG. 2 is the sectional view of the apparatus shown in FIG. 1 taken on arrowed line II through II.
Figure 3:
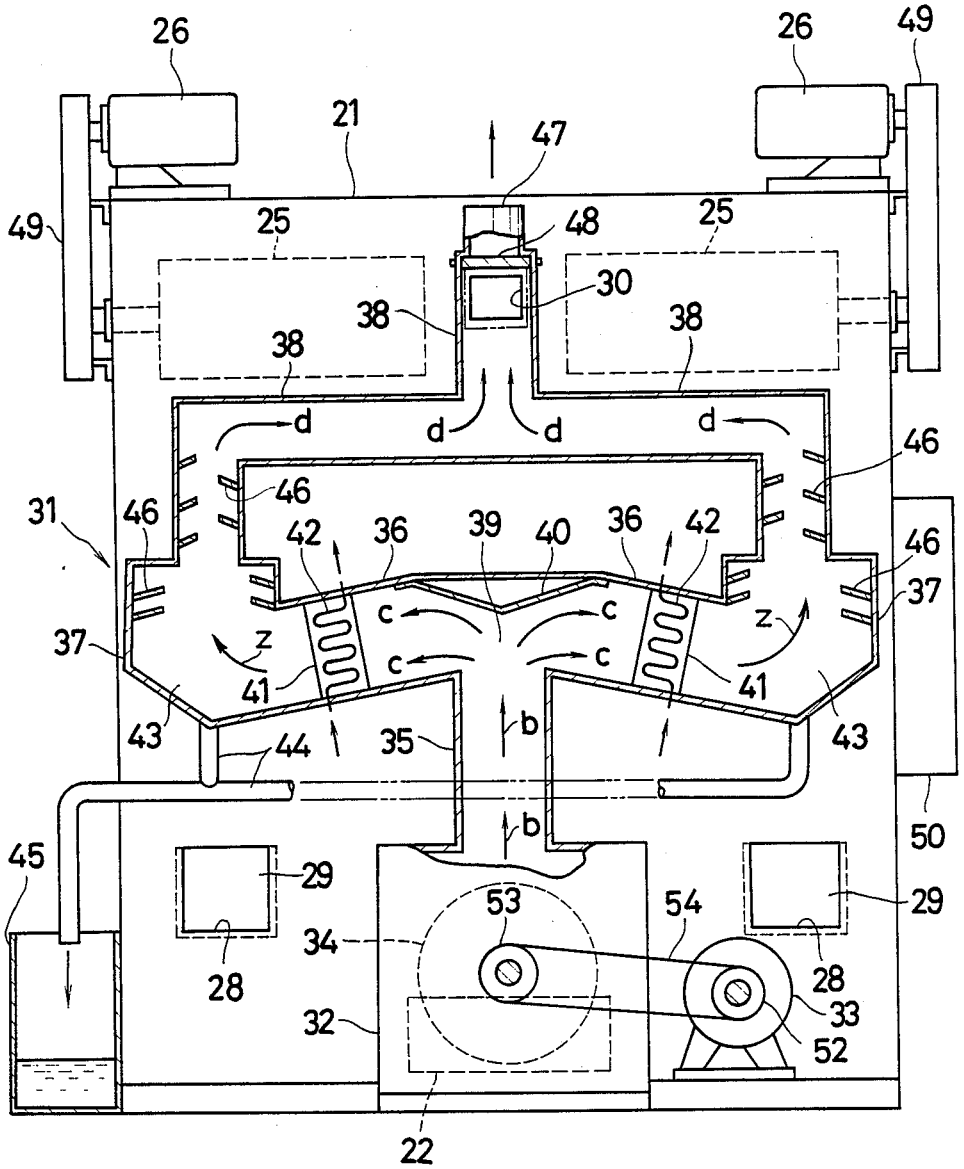
FIG. 3 is the sectional view of the apparatus shown in FIG. 2 taken on arrowed line III through III.

FIGS. 1 through 3 respectively denote the sectional views of the apparatus for processing dry-cleaned clothes being equipped with the solvent collector. A drying housing 12 is erected on the base 11, while the drying chamber 13 is provided inside of the drying housing 12 for treating the hung-up clothes A with a dry-cleaning process. Door 14 is provided on the front surface of the drying chamber 13 for taking clothes into and out of this chamber.

The upper aperture and the bottom part of the drying chamber 13 are respectively provided with metal nets 15 and 16.

Each two pieces of steam-jetting nozzles 17 and 17 are provided in parallel with each other in the bottom part of the upper metal net 15 and the upper part of the bottomo-side metal net 16 along the internal surface of the drying chamber 13.

A hanging bar 19 is horizontally set to the center position between the upper steam-jetting nozzles 17 and 17 for hanging clothes A with hangers 18.

Ducts 21 and 21 are respectively provided on the back surface and the upper surface of the drying housing 12 for making up the air circulation path 20 having the inverse L-shaped section. The back surface of the drying housing 12 is provided with the lower drying chamber **13*a* which is installed below metal net 16 and the central inlet port 22 interlinking the inlet of the fan-housing 32 of the solvent collector 31 to be described later on. Side inlets 23 and 23 are provided on both sides of the central inlet 22, which the side inlets 23 and 23 respectively have a specific diameter which is about one-half the diameter of the central inlet 22 connected to the bottom part of ducts 21 and 21**. In addition, the lower drying chamber 13a is installed between the central inlet 22 and the side inlets 23 and 23.

The lower drying chamber 13*a* facing the side inlets 23 and 23 is provided with two units of the inclined heaters 24 and 24 which respectively allow passage of air flow.

The upper corner portion of the air circulation path 20 connected to those side inlets 23 and 23 is provided with air-circulating fans 25 and 25 which circulate air from those side inlets 23 and 23 to the upper aperture of the drying chamber 13, while these fans 25 and 25 are driven by motors 26 and 26 mounted on the top surface of ducts 21 and 21.

Heaters 27 and 27 allowing air circulation are horizontally installed to the upper portion of metal net 15 above the drying chamber 13, where these heaters 27 and 27 are respectively connected to the blowing path of the air-circulating fans 25 and 25.

The lower back surfaces of ducts 21 and 21 are respectively provided with fresh-air inlets 28 and 28 for allowing fresh air to flow through the air-circulation path 20 inside of these ducts 21 and 21. These fresh-air inlets 28 and 28 are opened and closed by dampers 29 and 29, respectively.

The solvent collector 31 is installed between the central inlet 22 and the return hole 30 provided in the upper center position of duct 21.

As shown in FIGS. 2 and 3, the solvent collector 31 is provided with the fan housing 32 connected to the central inlet 22. Absorption fan 34 driven by motor 33 is provided inside of this fan housing 32 for absorbing air containing the used solvent from the drying chamber 13.

Blow-out duct 35 which upwardly extends itself is connected to the blower part of the absorption fan 34, while ducts 36 and 36 are respectively connected to the left and to the right of the upper end portion of the blow-out duct 35, where these ducts 36 and 36 obliquely extend themselves in the downward direction. These ducts 36 and 36 are also connected to tanks 37 and 37 which are respectively provided with substantial capacity, while return ducts 38 and 38 connecting the upper apertures of tanks 37 and 37 to the return holes 30 and 30 in the inverse T-shape are also installed, thus constituting the air-return path 39 connecting the upper and lower parts of the drying chamber 13 in the manner of forming by-pass.

In addition, air-current routing board 40 routing air current from the absorption fan 34 to the left and to the right by effect of impingement against the board 40 itself. Water-cooled radiators 41 and 41 are respectively installed inside of ducts 36 and 36 which interlink the blow-out port of the absorption fan 34 so that used solvent evaporated in air current can be condensed.

These water-cooled radiators 41 and 41 are respectively provided with corrugated fins (not shown) and water tubes 42 and 42 supplying water to the upward direction. Heated air which passes through corrugated fins and water tubes 42 and 42 is cooled by water flowing through these tubes before the evaporated solvent and water in air current can eventually be liquified.

Air passage in the rear part of these water-cooled radiators 41 and 41 is provided with a total area which is wider than that of the front part. Convection-generating chambers 43 and 43 are provided inside of tanks 37 and 37, whereas draining tubes 44 and 44 are respectively connected to the bottom part of these convection-generating chambers 43 and 43 for collecting the condensed liquified solvent. The bottom end of these draining tubes 44 and 44 are respectively connected to the liquified solvent storage tank 45.

A plurality of baffles 46 having their tip ends being oriented in the direction of air circulation are obliquely installed to specific portions of the air-current returning path 39, more specifically, to the upper position of the inner surface of tanks 37 and the power position of the inner surface of the return ducts 38 to expedite the fall of liquified solvent.

An exhaust damper 48 is installed to the upper part of the return duct 38 which makes up the air-current returning path 39 for selectively switching the air flow either to the exhaust port 47 or to the return hole 30.

See FIGS. 1 through 3, in which the reference numeral 49 denotes the pulley cover covering the pulley and the belt interlinking motor 26 and the air-circulation fan 25. The reference numeral 50 denotes the controller unit, whereas the reference numeral 51 denotes the pulley cover covering pulleys 52 and 53 and belt 54 interlinking motor 33 and air-circulation fan 34.

Next, functional operations of the apparatus for processing dry-cleaned clothes related to the invention are described below.

First, when drying the dry-cleaned clothes A using the drying apparatus mentioned above, as shown in FIGS. 1 and 2, the apparatus operator first hangs the dry-cleaned clothes A on a hanger 18. After hanging the hanger 18 on the hanging bar 19, the operator closes door 14 so that the drying chamber 13 can tightly be closed.

Then, the operator turns switch ON to feed power to heaters 24 and 27 installed to the upper and lower parts of the drying chamber 13. To prevent the drying chamber 13 from incurring negative pressure, as shown in FIG. 2, the operator then opens dampers 29 and 29 to allow fresh air to flow through the drying chamber 13. Next, the operator turns the switch of air circulation fans 25 and 25 ON, which are installed to both sides of the apparatus. This causes heated air current X to be blown out of the upper part of the drying chamber 13 in the downward direction. Simultaneously, the apparatus related to the invention causes the side inlet ports 23 and 23 set to the lower both sides to absorb hot air heated by heaters 24 and 24 so that hot air can be circulated in the arrowed direction "a". This raises temperature inside of the drying chamber 13 to about 90° C. for drying the dry-cleaned clothes A.

At the same time, the apparatus activates the solvent-collector 31 to collect the evaporated solvent from the circulating air current.

More particularly, as soon as the exhaust damper 48 closes the exhaust port 47, air-absorption fan 34 is activated to absorb air current Y containing evaporated solvent from the drying chamber 13 through the central inlet port 22 before allowing air current Y to be blown out of the blow-out part of the air absorption fan 34 so that air current Y can be led to the blow-out duct 35 in the arrowed direction "b".

Air current Y blown out of the blow-out duct 35 then impinges against the air-current routing board 40 so that it can be routed to the left and to the right as shown by arrows "c" before eventually being led into the water-cooled radiators 41 and 41 through ducts 36 and 36.

Air current Y containing evaporated solvent is then quickly and directly cooled by the water-cooled radiators 41 and 41, and as a result, evaporated water and solvent in air current Y is condensed before being liquified.

When air current Y containing evaporated solvent passes through the water-cooled radiators 41 and 41, corrugated fins of these radiators 41 and 41 respectively decelerate the air flow speed, and then, the decelerated air current is led into the convection-generating chambers 43 and 43 in which air current is subjected to convection, thus declerating the air flow speed furthermore to effectively expedite the fall of liquified solvent onto the bottom of the convection-generating chambers 43 and 43. Liquified solvent fell onto the bottom of these chambers 43 and 43 is eventually stored in the liquified solvent storage tank 45 via the draining tube 44.

Next, air current Z free from evaporated solvent then impinges against baffle 46 to expedite the fall of the condensed solvent before eventually returning to the drying chamber 13 via the return duct 38 and the return hole 30 in the arrowed direction "d" shown in FIGS. 2 and 3.

Next, after fully eliminating evaporated solvent from air current Y by repeating the air circulation mentioned above, the exhaust damper 48 is switched to the shadowed line position shown in FIG. 3 to open the exhaust port 48 to atmospherically release the solvent-free air current from the exhaust port 47.

Note that the apparatus related to the invention executes both the drying of the dry-cleaned clothes A and the collection of evaporated solvent from air current during a period of about 10 minutes.

Next, the operator closes dampers 29 and 29 on both sides of the apparatus for stopping absorption of fresh air before fully closing the drying chamber 13. Steam-jetting nozzles 17 and 17 in the upper and lower positions of the drying chamber 13 respectively impinge steam against the dry-cleaned clothes A. The operator then lowers temperature of heaters 24 and 27 to lower temperature of the drying chamber 13 to about 60° C. The apparatus then executes steaming of the dry-cleaned clothes A by stopping operations of both the air-circulation fan 25 and the air-absorption fan 34 for about 30 seconds.

The operator then activates operations of these fans 25 and 34 to allow steam to evenly circulate throughout the drying chamber 13 by flowing air from the top to the bottom of this chamber while fully closing the fresh-air intake damper 29 and the exhaust damper 48, thus allowing the drying chamber 13 to evenly apply steam to the dry-cleaned clothes A for 30 seconds.

While the steaming operation is underway, supply of water to the water-cooled radiators 41 and 41 is discontinued.

Next, while these dampers 29 and 48 remain closed, either of heaters 24 and 27 is inactivated to lower temperature furthermore. The operator then activates the rotations of the air-circulation fan 25 and the air-absorption fan 34 to circulate hot air current X from the top to the bottom of the drying chamber 13 for about 30 seconds at an extremely fast flow rate. This allows the apparatus to fully dry the dry-cleaned clothes A and simultaneously smooth out creases by effectively applying the swinging movement of clothes A in both directions and absorptive tension being generated downward.

Finally, the operator opens dampers 29 and 48 to allow fresh air to enter into the drying chamber 13 through fresh-air inlet ports 28 and 28 in order that temperature inside of the drying chamber 13 and the heated dry-cleaned clothes A can be cooled quickly. At the same time, heated air is fully exhausted out of the apparatus through the exhaust port 47 during a period of about 1 minute.

This cooling process effectively prevents even the slightest crease from restoring on the dry-cleaned clothes A. The apparatus related to the invention executes all the processes needed for finishing up dry-cleaned clothes including collection of used solvent, drying, steaming, finishing, and final cooling operations during a period of a maximum of about 14 minutes. This means that the apparatus related to the invention fully consummates all the dry-cleaning processes at a speed several times faster than any of the conventional apparatuses used for processing dry-cleaned clothes, and yet, the apparatus related to the invention securely finishes up the dry-cleaned clothes to an ideal condition which practically dispenses with subsequent pressing operations which are conventionally done with an additional finishing machine.

As is clear from the foregoing description, the preferred embodiment of the apparatus for processing dry-cleaned clothes related to the invention effectively dries the dry-cleaned clothes by circulating heated air current from the uppermost portion to the bottom of the drying chamber 13, and yet, the apparatus fully collects solvent evaporated from the dry-cleaned clothes from the heated air current by means of the solvent collector 31.

In addition, the apparatus related to the invention effectively smoothes out even the slightest crease from the dry-cleaned clothes by usefully applying combined effects of the steaming of the dry-cleaned clothes with the wet-steam jetting nozzle 17, the swinging movement of the steamed clothes generated by circulation of hot air from the uppermost to the bottom of the drying chamber 13, and the tension generated in the downward direction, respectively.

Furthermore, the apparatus related to the invention effectively prevents even the slightest crease from restoring itself on the finished clothes by means of cooling off temperature from the clothes by feeding fresh air from the fresh-air inlet port 28 to the drying chamber 13, thus collectively and totally finishing up the dry-cleaned clothes.

As a result, the apparatus related to the invention drastically reduces the time needed for completing entire processes without applying an additional finishing machine otherwise needed for any conventional processing apparatus.

In addition, since the apparatus related to the invention dries the dry-cleaned clothes by hanging them inside of the drying chamber 13, unlike any conventional tumbler-applied apparatus, the apparatus related to the invention securely prevents the dry-cleaned clothes from tangling themselves inside of the drying chamber 13, and as a result, those quality fabrics made from either cashmere or angora wool for example are fully protected from incurring damage.

Furthermore, since the apparatus related to the invention fully collects solvent evaporated from the dry-cleaned clothes, no volatile odor remains in the dry-cleaned clothes, and yet, the collected solvent is securely recycled for ensuing dry-cleaning operations.

This allows all the dry-cleaning shops to save the consumption of solvent to eventually reduce running cost. Furthermore, since the apparatus related to the invention does not release the uncollected solvent into atmosphere, the use of the apparatus related to the invention significantly helps promote preservation of clean environment as well.

Furthermore, introduction of the water-cooled radiators 41 and 41 allows the apparatus to be built with simplified constitution, thus eventually resulting in the inexpensive cost.

In conjunction with the constitution of the apparatus related to the invention and the preferred embodiment described above, it should be understood that heating means of the invention substantially corresponds to heaters 24 and 27 of the preferred embodiment.

Likewise, solvent collection means substantially correponds to the solvent collector 31 of the preferred embodiment, steam supplying means substantially corresponds to the steam-jetting nozzle 17 of the preferred embodiment, fresh-air intake means substantially corresponds to the fresh-air inlet port 28 of the preferred embodiment, and solvent collecting drainage substantially corresponds to the solvent-collecting draining tube 44 of the preferred embodiment, respectively.

It should be understood that the spirit and scope of the present invention are by no means confined to those constitutions of the preferred embodiment described above.

What is claimed is:

1. In an apparatus for dry cleaning clothes comprising a chamber comprising an upper portion, a lower portion and means for hanging clothes to be cleaned;

air circulation path connecting said upper portion and said lower portion;

means for causing air current to circulate through said air circulation path and inside said chamber from said upper portion to said lower portion;

means for supplying solvent to said chamber for cleaning said clothes;

means for heating air current passing through said air circulation path, said heating means being located at at least one of said upper portion and said lower portion;

means disposed near said chamber for supplying steam into said chamber; and means for feeding fresh air into said air circulation path; the improvement comprising air return path for connecting said lower portion to said upper portion;

first gate means for selectively connecting said lower portion to said air return path;

second gate means for selectively connecting said upper portion to said air return path;

fan means for causing air current containing evaporated solvent to flow from inside of said chamber through said air return path when said first gate means connects said lower portion to said air return path;

a pair of water cooled radiators for condensing solvent evaporated in said air current, each said radiator having a front end and a rear end, said front ends of both radiators being connected to respective entry paths, said entry paths being commonly connected through an opening path to said fan means, with a deflector means located substantially midway between said front ends of said radiators in said entry paths to enable splitting of air flow having evaporated solvent therein from said opening path into said front ends of said radiators;

solvent collecting means;

a pair of convection generating chambers each connected to respective rear ends of said radiators, each said convection generating chamber having an air passage area at the connection with said rear end of said radiator which is wider than an air passage area at the front end of said radiator, said convection generating chambers further comprising a bottom portion connected to said solvent collecting means; and a pair of exit paths connected to respective convection generating chambers and commonly connected to said second gate means.

2. The apparatus of claim 1, wherein said convection generating chambers each further comprises a plurality of baffles obliquely disposed toward said rear end of said radiator, and having tips extending in direction of air circulation.

* * * * *